US006112624A

United States Patent [19]

Chen

[11] Patent Number: 6,112,624

[45] Date of Patent: Sep. 5, 2000

[54] ROTARY LEVER ASSEMBLY FOR A WRENCH WITH A DIRECTION CONTROL MECHANISM

[76] Inventor: Yu-Tzu Chen, 8F-2, No. 255, Sec. 2, Sui-Yuan Rd., Taichung City, Taiwan

[21] Appl. No.: 09/257,362

[22] Filed: Feb. 25, 1999

Related U.S. Application Data

[63] Continuation-in-part of application No. 09/165,230, Oct. 1, 1998, abandoned.

[51] Int. Cl.[7] ..... B25B 13/00

[52] U.S. Cl. ..... 81/59.1; 192/84.81

[58] Field of Search ..... 192/84.81; 81/87.14, 81/89.2, 213.2, 60–63.2, 59.1

[56] References Cited

U.S. PATENT DOCUMENTS

| | | | |
|---|---|---|---|
| 4,407,175 | 10/1983 | Graham | 81/59.1 |
| 5,012,705 | 5/1991 | Chow | 81/61 |
| 5,499,559 | 3/1996 | Lin | 81/59.1 |
| 5,509,331 | 4/1996 | Nickipuck | 81/59.1 |
| 5,941,140 | 8/1999 | Suksi | 81/59.1 |
| 5,943,924 | 8/1999 | Jarvis | 81/60 |

*Primary Examiner*—David A. Scherbel
*Assistant Examiner*—Daniel Shanley
*Attorney, Agent, or Firm*—Rosenberg, Klein & Lee

[57] ABSTRACT

A rotary lever assembly for a wrench includes an elongated tubular coupler, which has a tongue of a polygonal cross-section that is adapted to engage fittingly a polygonal groove in a socket portion of a fastener-rotating element. A movable rod is mounted movably in the coupler, and is biased by a spring to an extended position, in which a ball projects partially from a hole in the tongue to engage a positioning cavity in the socket portion. In this way, the fastener-rotating element can rotate synchronously with the coupler of the rotary lever assembly. When the movable rod is pushed to a retracted position, a hole in the movable rod is aligned with the hole in the tongue. In this case, the socket portion can move on the tongue in view of the condition that the inner surface of the socket portion pushes the ball to retract entirely into the hole in the tongue. When the movable rod is released and is thus biased by the spring to move from the retracted position to the extended position, an inclined guide surface of the movable rod pushes the ball to project partially from the hole in the tongue.

3 Claims, 5 Drawing Sheets

ROTARY LEVER ASSEMBLY FOR A WRENCH WITH A DIRECTION CONTROL MECHANISM

CROSS-REFERENCE OF RELATED APPLICATION

This application is a Continuation-in-Part (CIP) of U.S. patent application Ser. No. 09/165,230, which was filed on Oct. 1, 1998 abandoned.

BACKGROUND OF THE INVENTION

1. Field of the Invention

This invention relates to a rotary lever assembly for a wrench which is provided with a direction control mechanism, more particularly to a rotary lever assembly, which is provided with a coupler that is retained on a fastener-rotating element by means of a spring-biased ball.

2. Description of the Related Art

In a tool kit, a wrench unit normally consists of a rotary lever assembly and several separate fastener-rotating elements, which are used to grip and turn fasteners, such as nuts or bolts. In this case, each of the fastener-rotating elements has a socket portion, which is typically retained on the rotary lever assembly by means of a spring-biased ball, on which a spring presses directly. When removing any of the fastener-rotating elements from the rotary lever assembly, it is necessary to hold and pull the two away from each other using the two hands of the user, thereby resulting in a difficult and energy-consuming process.

SUMMARY OF THE INVENTION

The object of this invention is to provide a rotary lever assembly for a wrench, which can be removed easily from a fastener-rotating element using only one hand of the user.

According to this invention, a rotary lever assembly for a wrench includes an elongated tubular coupler, which has a tongue of a polygonal cross-section that is adapted to engage fittingly a polygonal groove in a socket portion of a fastener-rotating element. A movable rod is mounted movably in the coupler, and is biased by a spring to an extended position, in which a ball projects partially from a hole in the tongue to engage a positioning cavity in the socket portion. In this way, the fastener-rotating element can rotate synchronously with the coupler of the rotary lever assembly. When the movable rod is pushed to a retracted position, a hole in the movable rod is aligned with the hole in the tongue. In this case, the socket portion can move on the tongue in view of the condition that the inner surface of the socket portion pushes the ball to retract entirely into the hole in the tongue. When the movable rod is released and is thus biased by the spring to move from the retracted position to the extended position, an inclined guide surface of the movable rod pushes the ball to project partially from the hole in the tongue.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
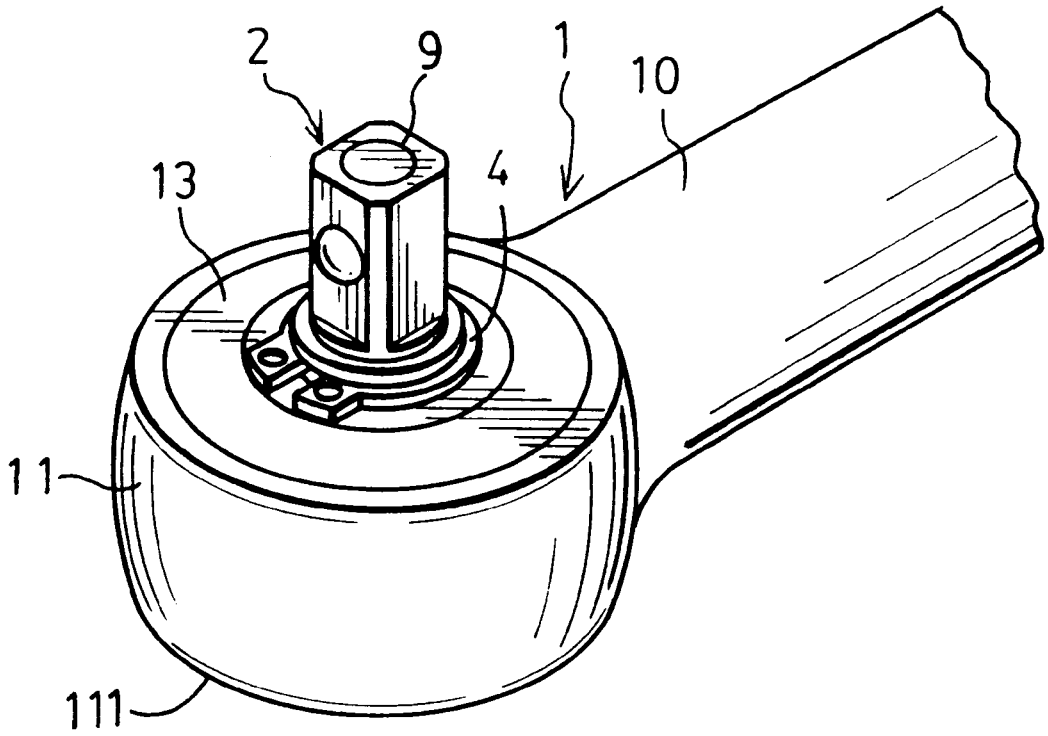
FIG. 1 is a fragmentary perspective view of the preferred embodiment of a rotary lever assembly for a wrench according to this invention.

Referring to FIGS. 1 to 4, a preferred embodiment of a rotary lever assembly for a wrench according to this invention is shown. The preferred embodiment includes a wrench body 1, an elongated tubular coupler 2, a direction control mechanism 3, an upper rigid C-shaped ring 4, a lower rigid C-shaped ring 5, and a C-shaped rubber ring 6.

The wrench body 1 has a horizontal handle 10 and a hollow cylindrical driving head 11, which is formed integrally with the handle 10 and which has an open upper end 110 and an open lower end 111.

The coupler 2 is mounted within an interior space 12 in the driving head 11 of the wrench body 1, and has a hexagonal-cross-sectioned portion 20 and a tongue 21, which has a generally square cross-section. The hexagonal-cross-sectioned portion 20 has six side walls 20A, each of which has two vertical edges 20B and two edge portions 20C, 20D (see FIGS. 5 and 6) that are located adjacent to the vertical edges 20B, respectively.

The direction control mechanism 3 includes a rotary member 30, a plurality of angularly equidistant posts 31, a plurality of angularly equidistant vertical stop cylinders 32, and three positioning units.

The rotary member 30 is mounted rotatably within the driving head 11 of the wrench body 1, and has a top surface 301 and a bottom surface 302.

The posts 31 extend integrally and upwardly from the top surface 301 of the rotary member 30, and are in frictional contact with the inner surface of the hollow cylindrical driving head 11 of the wrench body 1. As illustrated, the posts 31 have a generally trapezoid cross-section.

Figure 6:
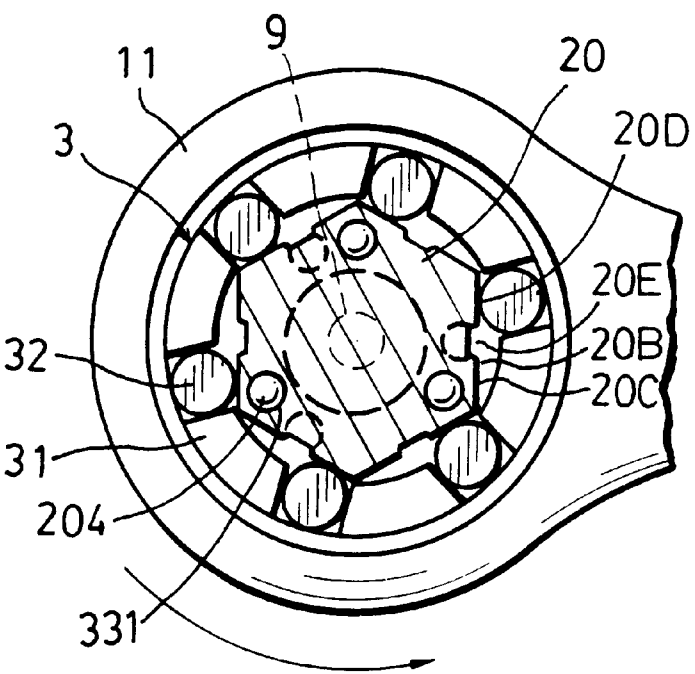
FIG. 6 illustrates how the direction control mechanism of this invention is operated to rotate a fastener counterclockwise.
Figure 5:
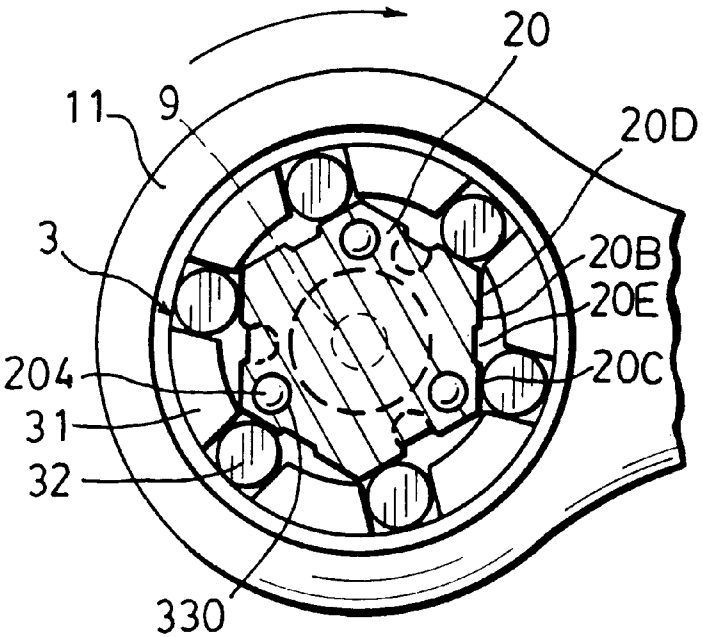
FIG. 5 illustrates how a direction control mechanism of the preferred embodiment is operated to rotate a fastener clockwise.

Each of the stop cylinders 32 is confined between an adjacent pair of the posts 31 and between the driving head 11 of the wrench body 1 and the hexagonal-cross-sectioned portion 20 of the coupler 2. As shown in FIGS. 5 and 6, each of the stop cylinders 32 contacts an adjacent pair of the posts 31, the driving head 11 and a side wall 20B of the hexagonal-cross-sectioned portion 20 to permit rotation of the rotary member 30 with the wrench body 1.

Referring again to FIGS. 1 to 4, each of the positioning units includes adjacent first and second positioning holes 203, 204 which are formed in a bottom surface 201 of the hexagonal-cross-sectioned portion 20 of the coupler 2, and a spring-biased ball unit having a ball 331 which is received within a well 332 in the top surface 301 of the rotary member 30 and which is biased by a coiled spring 330 to engage a selected one of the first and second positioning holes 203, 204.

The hollow cylindrical driving head 11 of the wrench body 1 has a small-inner-diameter upper portion 112 and a large-inner-diameter lower portion 113, between which a shoulder 120 is defined. The bottom surface 201 of the hexagonal-cross-sectioned portion 20 of the coupler 2 contacts the shoulder 120 of the driving head 11.

The coupler 2 further has a lower central shaft 200A extending integrally and downwardly from the hexagonal-cross-sectioned portion 20 and through a central hole 300 in the rotary member 30, and an upper central shaft 200B extending integrally and upwardly from the hexagonal-cross-sectioned portion 20.

A rigid ring plate 13 is fitted within the upper end 110 of the driving head 11 of the wrench body 1, and is sleeved on the upper central shaft 200B of the coupler 2. The plate 13 rests on the hexagonal-cross-sectioned portion 20 of the coupler 2.

The upper rigid C-shaped ring 4 is engaged within an annular groove 210 in the upper central shaft 200B of the coupler 2, and is located immediately over the ring plate 13, thereby retaining the ring plate 13 on the coupler 2.

The lower rigid C-shaped ring 5 is engaged within an annular groove 211 in the lower central shaft 200A of the coupler 2, and supports the rotary member 30 thereon, thereby confining the rotary member 30 within the large-inner-diameter lower portion 112 of the driving head 11.

The C-shaped rubber ring 6 is engaged within an annular groove 131 in an outer peripheral surface of the ring plate 13 and an annular groove 114 in an inner surface of the driving head 11. The ring plate 13 is therefore positioned relative to the wrench body 1, thereby retaining the coupler 2 and the rotary member 30 within the driving head 11.

The rotary member 30 has two ears 34, 35 (see FIG. 3) which extend integrally and downwardly from the bottom surface 302 and which can be held so as to rotate the rotary member 30 relative to the coupler 2, thereby permitting the spring-biased balls 204 to engage a selected one of the first and second positioning holes 330, 331.

Referring to FIG. 5, in a situation where the spring-biased balls 331 engage the first positioning holes 203 (indicated by the solid lines) so as to contact the stop cylinders 32 with the edge portions 20C of the side walls 20B of the hexagonal-cross-sectioned portion 20, the hexagonal-cross-section portion 20 can rotate with the driving head 11 in only a first direction, i.e. clockwise direction.

Referring to FIG. 6, the spring-biased balls 331 engage the second positioning holes 204 (indicated by the solid lines) so as to contact the stop cylinders 32 with the edge portions 20D of the side walls 20B of the hexagonal-cross-sectioned portion 20. In this case, the hexagonal-cross-section portion 20 can rotate with the driving head 11 in only a second direction, i.e. counterclockwise direction.

Figure 2:
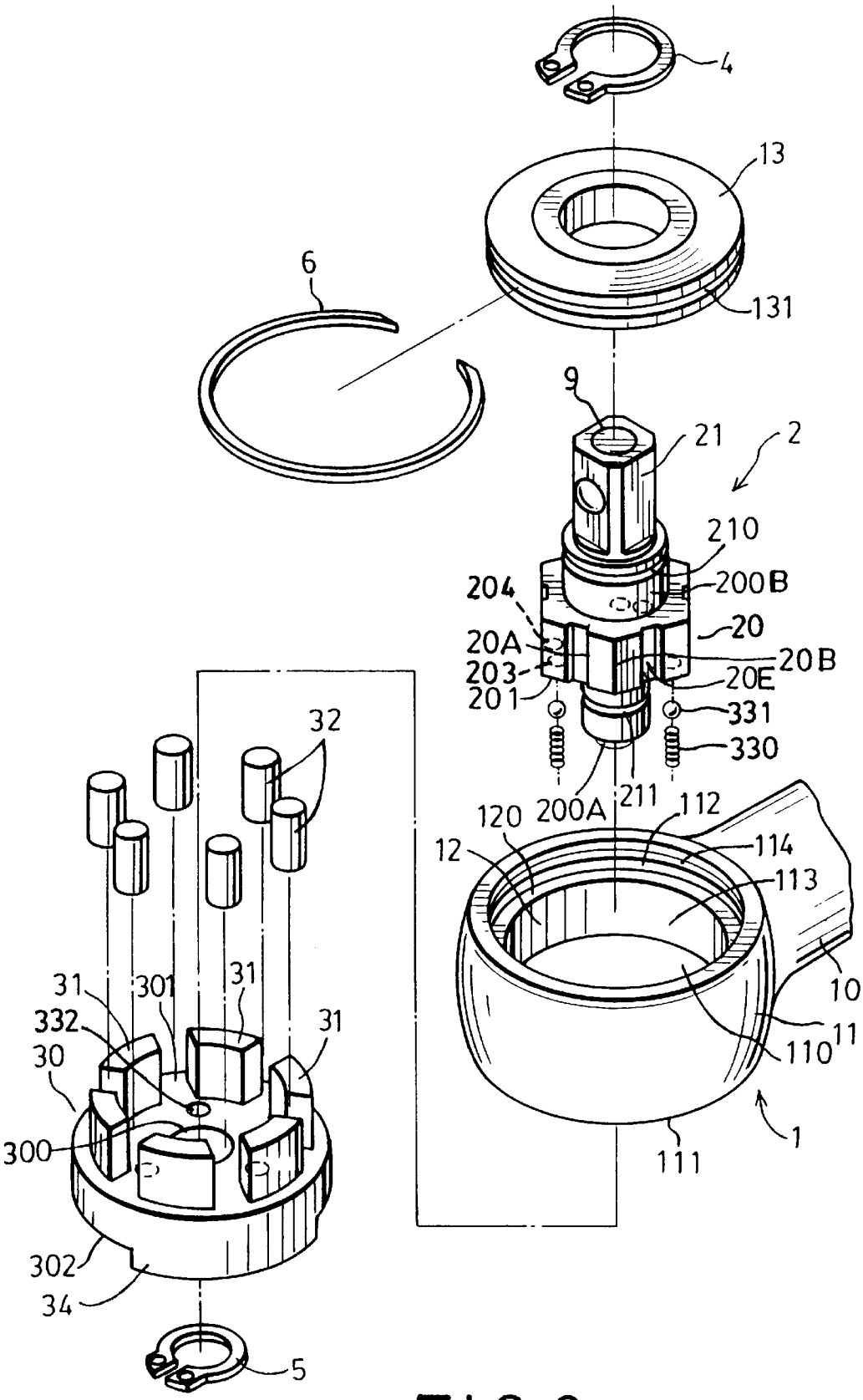
FIG. 2 is an exploded view of the preferred embodiment.
Figure 3:
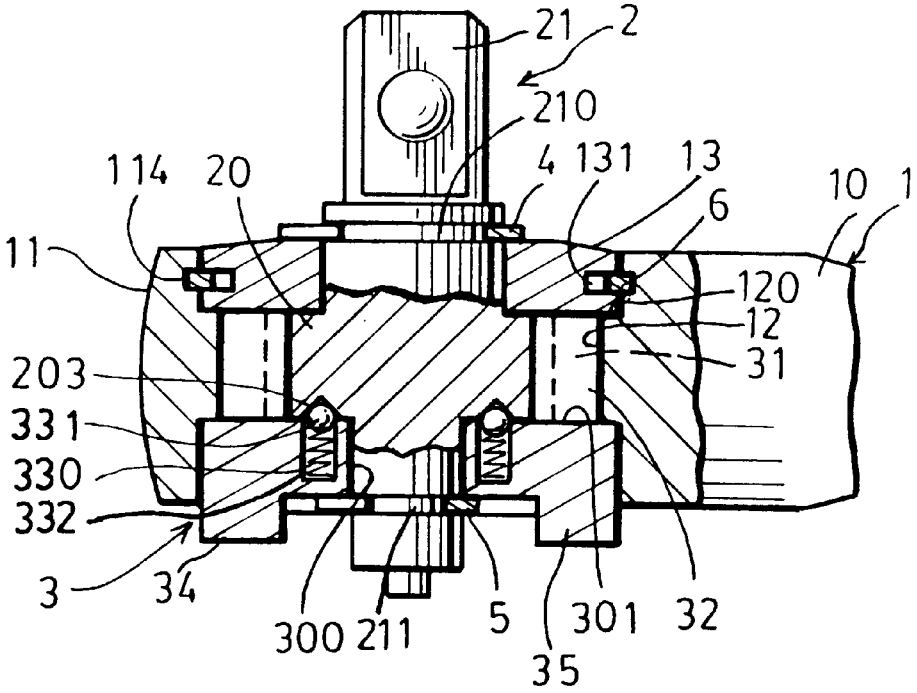
FIG. 3 is a sectional view of a portion of the preferred embodiment.
Figure 4:
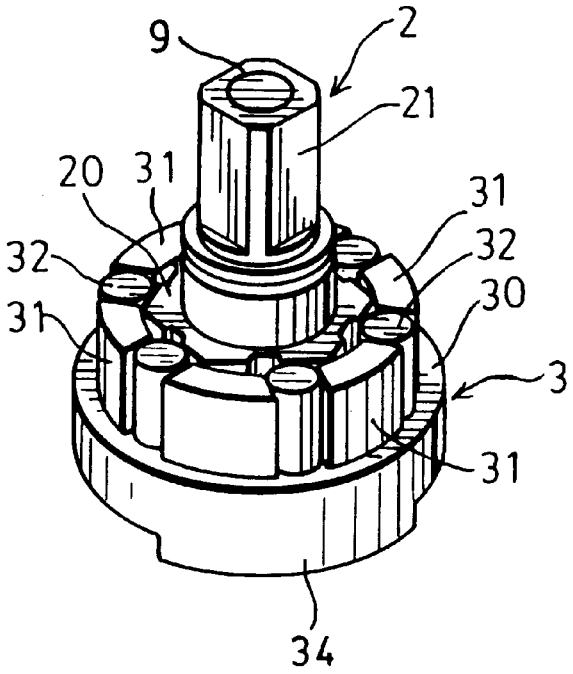
FIG. 4 is a perspective view showing an assembly of a coupler, a rotary member and a plurality of vertical cylinders of the preferred embodiment.

Referring to FIGS. 2, 5 and 6, each of the side walls 20A of the hexagonal-cross-sectioned portion 20 of the coupler 2 further has a vertical slot 20E, which is located between the edge portions 20C and 20D. Each of the slots 20E can prevent sliding movement of the corresponding cylinder 32 on the side wall 20A from one of the edge portions 20C, 20D to the other when the manufacturing error of the rotary member 30 is too much. Accordingly, a relative low precision is permitted in the rotary lever assembly of this invention.

Figure 7:
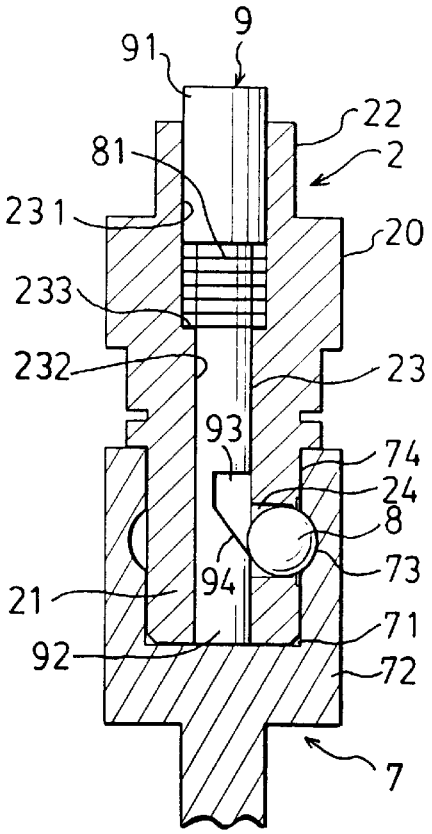
FIG. 7 is a schematic sectional view illustrating how a movable rod of the preferred embodiment is located at an extended position, in which a portion of a ball projects from a ball receiving hole in a coupler.
Figure 7A:
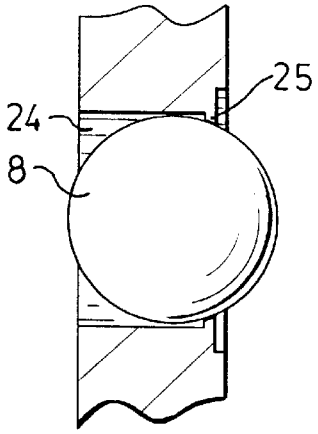
FIG. 7A is a schematic view illustrating how the ball is confined within the ball receiving hole in the coupler of the preferred embodiment by an inward flange.

Referring to FIGS. 7 and 7A, the tongue 21 of the coupler 2 is adapted to engage fittingly a square groove 71 in a socket portion 72 of a unitary fastener-rotating element 7, such as a screwdriver or a spanner. The tongue 21 includes a spring-biased ball 8 adapted to engage one of the positioning cavities 73, which are formed respectively in interior side walls 74 that define cooperatively the groove 71 in the socket portion 72 of the fastener-rotating element 7. Accordingly, the fastener-rotating element 7 can rotate synchronously with the tongue 21 of the coupler 2.

The coupler 2 includes a tubular body 22, which has an axial central bore 23 that is formed through the tubular body 22 and that has a large-diameter section 231 and a small-diameter section 232. The small-diameter section 232 has a diameter smaller than that of the large-diameter section 231. The large-diameter and small-diameter sections 231, 232 define a shoulder 233 therebetween. The tubular body 22 further has a ball receiving hole 24, which is formed radially in a wall of the tubular body 22 and which is communicated with the central bore 23, and an inward flange 25, which extends inward into a radial outer end portion of the ball receiving hole 24.

A movable rod 9 is disposed movably within the central bore 23 in the tubular body 22, and has a thick portion 91 and a thin portion 92, which is thinner than the thick portion 91. The diameter of the thick portion 91 is slightly smaller than that of the large-diameter portion 231 of the central bore 23 in the tubular body 22. The diameter of the thin portion 92 is slightly smaller than that of the small-diameter section 232 of the central bore 23 in the tubular body 2. The movable rod 9 further has a retaining hole 93 and an inclined surface 94.

The ball 8 is confined within the hole 24 in the tubular body 22 by the inward flange 25, and extends partially from the hole 24 in the tubular body 22. The flange 25 is formed by hammering the wall of the tongue 21, which defines the hole 24, after the ball 8 is placed in the holes 93, 24.

Figure 8:
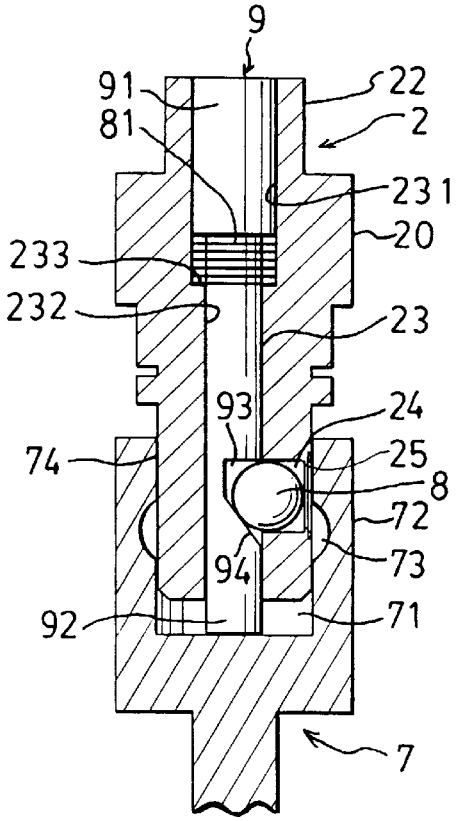
FIG. 8 is a schematic sectional view illustrating how the movable rod is located at a retracted position, in which the portion of the ball is retracted entirely into the receiving hole in the coupler.

A coiled spring 81 is sleeved on the thin portion 92 of the movable rod 9 between the thick portion 91 of the movable rod 9 and the shoulder 233 of the tubular body 22 to bias the movable rod 9 to an extended portion. In this situation, an end portion of the thick portion 91 of the movable rod 9 extends from the central bore 23 in the tubular body 22. The end portion of the thick portion 91 of the movable rod 9 can be pushed to move the movable rod 9 to a retracted position, as shown in FIG. 8. In this situation, the retaining hole 93 is aligned with the ball receiving hole 24, thereby permitting movement of the socket portion 72 on the tongue 21 in view of the condition that the inner surface of the socket portion 72 pushes the ball 8 to retract entirely into the holes 93, 24.

When the movable rod 9 is located at the retracted position, the ball 8 contacts the inclined guide surface 94 of the movable rod 9. When the movable rod 9 is released and is thus biased by the spring 81 to move from the retracted position to the extended position, the ball 8 is pushed by the inclined guide surface 94 of the movable rod 9 to project partially from the ball receiving hole 24 in the tubular body 22.

With this invention thus explained, it is apparent that numerous modifications and variations can be made without departing from the spirit and scope of this invention. It is therefore intended that this invention be limited only as indicated in the appended claims.

I claim:

1. A rotary lever assembly for a wrench, the wrench including a fastener-rotating element with a socket portion, which has a plurality of interior side walls that define cooperatively a polygonal groove, each of the interior side walls being formed with a positioning cavity, said rotary lever assembly including an elongated tubular coupler, which has a tongue of a polygonal cross-section that is adapted to engage fittingly the groove in the fastener-rotating element, said tongue including a spring-biased ball, which is adapted to engage one of the positioning cavities in the socket portion of the fastener-rotating element so as to retain said tongue within the socket portion of the fastener-rotating element, thereby permitting synchronous rotation of the fastener-rotating element with said coupler, wherein the improvement comprises:

a wrench body having a horizontal handle and a hollow cylindrical driving head, which is formed integrally with said handle and which has an open upper end and an open lower end, said driving head of said wrench body having a small-inner-diameter upper portion and a large-inner-diameter lower portion, between which a shoulder is defined:

said coupler being mounted rotatably within said driving head and including:

a tubular body having an axial central bore, which is formed through said coupler and which has a large-diameter section and a small-diameter section that is smaller in diameter than said large-diameter section, said large-diameter and small-diameter sections defining a shoulder therebetween, said tubular body having a polygonal-cross-sectioned portion, which has a plurality of side walls, each of which has two vertical edges, two edge portions that are located respectively adjacent to said vertical edges, and a vertical slot that is located between said edge portions, said polygonal-cross-sectioned portion of said coupler having a top surface and a bottom surface, which contacts said shoulder of said wrench body, said tubular body further having a ball receiving hole, which is formed radially in a wall of said tubular body and which is communicated with said central bore, and an inward flange, which extends inward into a radial outer end portion of said ball receiving hole;

a moveable rod being disposed movably within said central bore in said tubular body and having a thick portion and a thin portion, which is thinner than said thick portion, said thick portion of said movable rod being slightly smaller in diameter than said large-diameter section of said central bore in said tubular body, said thin portion of said movable rod being slightly smaller in diameter than said small-diameter section of said central bore in said tubular body, said movable rod having a retaining hole and an inclined guide surface;

a lower central shaft extending integrally and downwardly from said polygonal-cross-sectioned portion, and an upper central shaft extending integrally and upwardly from said polygonal-cross-sectioned portion;

said ball being confined within said hole in said tubular body by said inward flange of said tubular body and extending partially from said hole in said tubular body; and a coiled spring sleeved on said thin portion of said movable rod between said thick portion of said movable rod and said shoulder of said tubular body to bias said movable rod to an extended portion, in which an end portion of said thick portion of said movable rod extends from said central bore in said tubular body, said end portion of said thick portion of said movable rod being capable of being pushed to move said movable rod to a retracted position, in which said retaining hole in said movable rod is aligned with said ball receiving hole in said tubular body, thereby permitting movement of the socket portion on said tongue due to the fact that the socket portion pushes said ball to retract entirely into said ball receiving hole in said tubular body and said retaining hole in said movable rod, location of said movable rod at said retracted position permitting said ball to contact said inclined guide surface of said movable rod so that, when said movable rod is released and is thus biased by said spring to move from said retracted position to said extended position, said ball is pushed by said inclined guide surface of said movable rod to project partially from said ball receiving hole in said tubular body;

a rigid ring plate fixed within said upper end of said driving head and sleeved on said upper central shaft of said coupler; and, a direction control mechanism including:

a rotary member mounted rotatably within said driving head and confined within said large-inner-diameter lower portion of said driving head of said wrench body, said rotary member having a top surface and a central hole which is formed therethrough, said lower central shaft of said coupler extending through said central hole in said rotary member, thereby journalling said coupler on said ring plate and said rotary member;

a plurality of angularly equidistant posts extending integrally and upwardly from said top surface of said rotary member and being in frictional contact with said driving head;

a plurality of angularly equidistant vertical stop cylinders, each of which being confined between an adjacent pair of said posts and between said driving head of said wrench body and said polygonal-cross-sectioned portion of said coupler, each of said cylinders contacting the adjacent pair of said posts, said driving head of said wrench body and one of said edge portions of one of said side walls of said polygonal-cross-sectioned portion of said coupler to permit rotation of said rotary member with said wrench body in only a first direction; and a positioning unit including an adjacent pair of first and second positioning holes that are formed in one of said coupler and said rotary member, and a spring-biased ball unit which is disposed on the other one of said coupler and said rotary member and which includes a well formed in a corresponding one of said coupler and said rotary member, a ball placed in said well, and a coiled spring that pushes a portion of said ball from aid well to engage a selected one of said first and second positioning holes, said rotary member being capable of being rotated relative to said coupler so as to move said spring-biased ball unit from the selected one of said first and second positioning holes to the other one of said first and second positioning holes, thereby permitting said coupler to rotate with wrench body in only a second direction which is opposite to the first direction.

2. A rotary lever assembly as claimed in claim 1, wherein said small-inner-diameter upper portion of said driving head has an inner surface which is formed with an annular groove, said ring plate having an outer peripheral surface which is formed with an annular groove, said wrench further including a C-shaped rubber ring engaged within said annular grooves in said ring plate and said small-inner-diameter upper portion of said driving head so as to fix said ring plate relative to said wrench body, thereby confining said coupler within said small-inner-diameter upper portion of said driving head.

3. A rotary lever assembly as claimed in claim 1, wherein each of said lower and upper central shafts has an annular groove formed therein, said rotary lever assembly further including:

an upper rigid C-shaped ring engaged within said annular groove in said upper central shaft of said coupler and located immediately over said ring plate, thereby retaining said ring plate on said coupler; and a lower rigid C-shaped ring engaged within said annular groove in said lower central shaft of said coupler and supporting said rotary member on said lower rigid C-shaped ring, thereby confining said rotary member within said large-inner-diameter lower portion of said driving head.

* * * * *